United States Patent [19]

Herbert

[11] Patent Number: 4,921,450

[45] Date of Patent: May 1, 1990

[54] SPACE SAVING MULTIPOLE FUSE BLOCK

[75] Inventor: William G. Herbert, Ellisville, Mo.

[73] Assignee: Cooper Industries, Inc., Houston, Tex.

[21] Appl. No.: 324,135

[22] Filed: Mar. 16, 1989

[51] Int. Cl.[5] ..... H01R 13/68

[52] U.S. Cl. ..... 439/621; 337/215

[58] Field of Search ..... 439/621, 622, 698, 709; 337/214, 215

[56] References Cited

U.S. PATENT DOCUMENTS

| | | | |
|---|---|---|---|
| 3,142,738 | 7/1964 | Friedman | 337/215 |
| 3,732,516 | 5/1973 | Puetz | 439/622 |
| 4,647,141 | 3/1987 | Muench et al. | 439/716 |

FOREIGN PATENT DOCUMENTS

| | | | |
|---|---|---|---|
| 3526494 | 1/1987 | Fed. Rep. of Germany | 439/716 |

*Primary Examiner*—Gary F. Paumen

*Attorney, Agent, or Firm*—Nelson A. Blish; Eddie E. Scott; Alan R. Thiele

[57] ABSTRACT

A space saving multipole fuse block 20 wherein side poles 32 are tilted outward approximately 30° from center pole 30. In control panels for electrical equipment it is necessary to save space by minimizing the base area of components. Tilting side poles 32 to put the bottom of fuse clips 24 on side poles 32 under the fuse clip 24 of center pole 30 and also using fuse clips 24 with a U-shaped base results in further space saving.

7 Claims, 2 Drawing Sheets

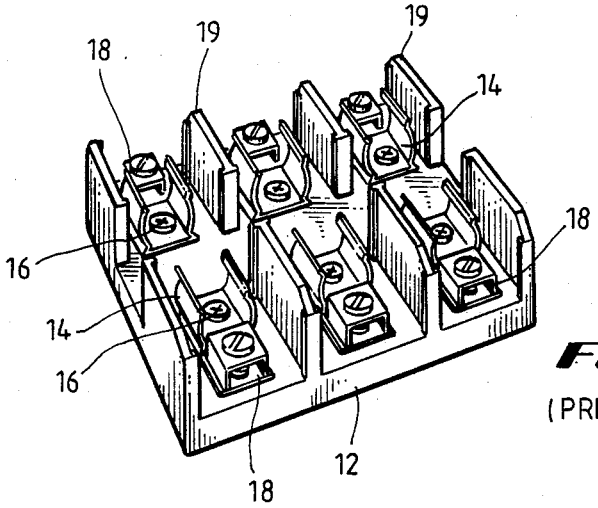
Fig. 1
(PRIOR ART)
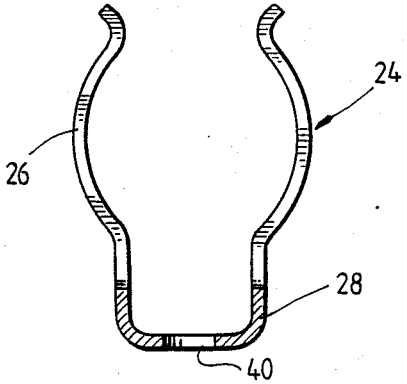
Fig. 4
Fig. 5
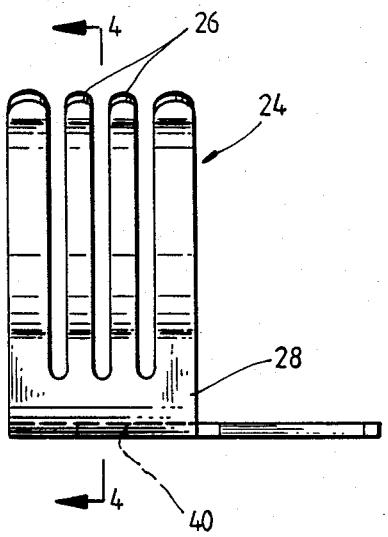

SPACE SAVING MULTIPOLE FUSE BLOCK

BACKGROUND OF THE INVENTION

This application relates to fuse holders in general, and in particular to a fuse block having reduced cross sectional base area for Class J fuses.

It is well known to mount fuse blocks in control panels for electrical equipment. The trend has been to decrease the size of components; for example the controllers mounted in the panels have decreased in size in recent years. Yet the fuse blocks for holding the fuses have remained approximately the same size.

It would be desirable to reduce the cross sectional base area of the fuse blocks to allow mounting of additional devices in controller panels, or alternately to decrease the size of the panels.

SUMMARY OF THE INVENTION

In the present invention for a three pole fuse block, the center pole is at a level above the two side poles. The two side poles are canted at a 30° angle outward from the center in order for the base of the two side poles to be tucked underneath the center fuse pole, thereby saving space, and allowing for easier access for pulling the side mounted fuses.

BRIEF DESCRIPTION OF THE DRAWINGS

FIG. 1 shows a perspective view of a prior art fuse holder.

FIG. 4 shows a front view of a fuse clip as used in the present invention.

FIG. 5 shows a side view of the fuse clip shown in FIG. 4.

DETAILED DESCRIPTION OF THE INVENTION

Figure 3:
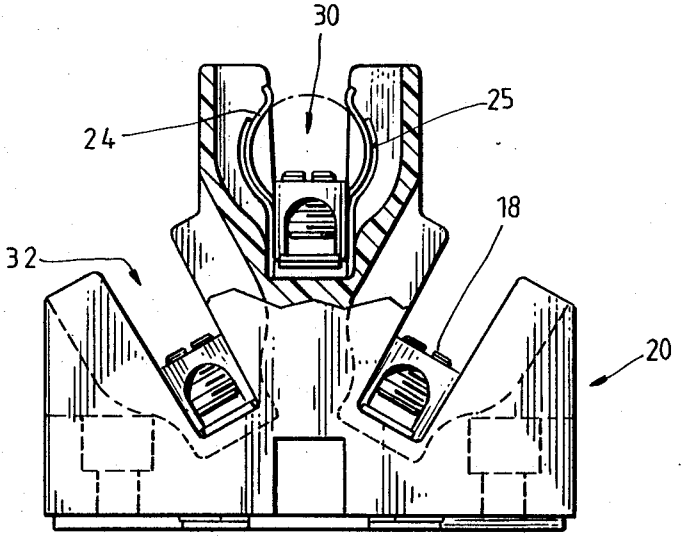
FIG. 3 shows a front view partially in phantom of a fuse holder according to the present invention.

FIG. 1 shows a prior art fuse block, designated in general by reference number 10. In prior art fuse blocks, fuses are generally mounted side by side as is shown. Fuse clips 14 are used to hold each end of a cylindrical fuse. Thus there are two fuse clips for each fuse. Fuse clips 14 are mounted to base 12 of fuse block 10 by means of screws 16. Wire connectors 18 are used to attach wire leads to fuse clips 14. Barriers 19 are used to separate fuse clips, and fuses, not shown, and to electrically isolate the live parts so that for example, proper spacing, creepage, and clearance distances are maintained and metal tools dropped across the top of the fuse block will not short the poles of fuses.

Figure 2:
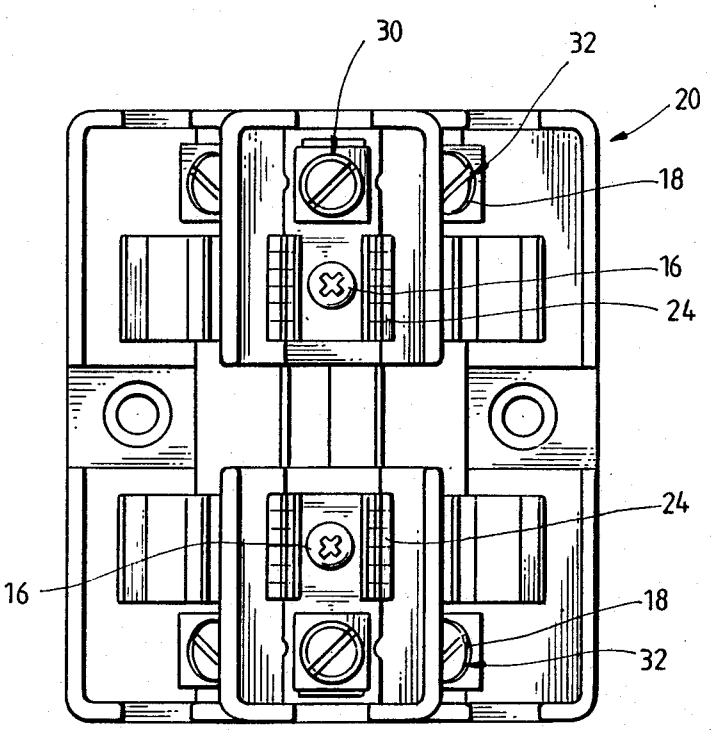
FIG. 2 shows a top view of a fuse holder according to the present invention.

In a fuse block 20, according to the present invention, shown in FIGS. 2 and 3, center pole 30 is at an elevated height above the two side poles 32. Fuse clips 24, described in more detail below, are used to hold fuses in both the center pole and the side poles. Fuse clips 24 are secured on by screws 16 or rivets or other means well known in the art. Standard wire connectors 18 are used to attach wires to fuse clip 24.

In the preferred embodiment shown in front view in FIG. 3, side poles are mounted at approximately 30° angle, outward from center pole 30 which is mounted at approximately 90° from the base. The purpose of this 30° mounting is two fold. It enables the fuse clips 24 of the side poles 32 to be tucked in beneath the fuse clips 24 of the center pole 30, thus saving additional cross sectional area on the base of fuse block 20. An additional purpose is served in that a standard fuse puller can be used to remove not only the fuse from center pole 30, but fuses from side poles 32. If side poles 32 were mounted with a vertical axis, and still close enough to save additional space in a control panel, a standard fuse puller could not be used to remove fuses.

FIG. 4 shows an end view of slotted fuse clip 24. According to the present invention slotted fuse clip 24 has a U-shaped based 28, as opposed to conventional fuse clip, which has a flared portion at the base. This results in additional space savings in the present invention.

FIG. 5 shows a side view from the right of the fuse clip 24 shown in FIG. 4, showing fingers 26. Using individual fingers 26 in a clip provides an increase in the amount of electrical contact points between the ferrule of a fuse and the fuse clip, thereby improving electrical contact and reducing resistance which allows the holder to run cool.

Thus it is seen that in a fuse block for class J fuses, or any other class of fuses mounted three at a time, the base area of the fuse block is significantly reduced over prior art fuse blocks. The area occupied by the fuse block according to the present invention is approximately $\frac{2}{3}$ the area occupied by standard prior art fuse blocks.

While a specific embodiment of the invention has been showed, it will be understood by those skilled in the art that other embodiments fall within the scope of the invention and the scope of the claims. For example, the angle that the side poles are mounted at with, respect to the center pole, may be 25°, 30°, 35° or other angles and still encompass the sphere of the present invention.

Also the present invention is designed for fuse blocks holding two or more fuses even though the invention has been illustrated using three fuses. It merely being necessary that the fuse poles are at different levels or heights above the base of the fuse block.

I claim:

1. In a fuse block for mounting cylindrical fuses, the improvements comprising:

said fuse block having a bottom surface;

a center pole having a first fuse clip and a second fuse clip adapted to receive therein a first end and a second end, respectively, of a said fuse, said center pole being mounted on said fuse block; and a first side pole having a first fuse clip and a second fuse clip adapted to receive therein a first end and a second end, respectively, of a said fuse, said first side pole being mounted on said fuse block at a level closer to said bottom surface than said center pole and angled outwardly from said center pole.

2. A fuse block as in claim 1 wherein there is a second side pole, on a side of said fuse block opposite said first side pole and mounted at a level approximately equal said first side pole and at an angle outward from said center pole.

3. A fuse block as in claim 2 wherein the angle of said second side pole is approximately equal to the angle of said first side pole.

4. A fuse block as in claim 2 wherein said side poles are angled outwardly approximately 30° from said center pole.

5. A fuse block as in claim 2 wherein said fuse block is an insulating plastic material.

6. A fuse block as in claim 1 wherein each said fuse clip comprises:

a U-shaped base; and electrically conductive fingers.

7. In a fuse block for mounting cylindrical fuses, the improvements comprising:

said fuse block having a bottom surface;

a center pole having a first fuse clip and a second fuse clip adapted to receive therein a first end and a second end, respectively, of a said fuse, said center pole being mounted on said fuse block; and a first side pole having a first fuse clip and a second fuse clip adapted to receive therein a first end and a second end, respectively, of a said fuse, said first side pole being mounted on said fuse block at a level closer to said bottom surface than said center pole and angled outwardly from said center pole at an angle less than 90 degrees.

* * * * *